US008888562B2

(12) United States Patent
Miyashita et al.

(10) Patent No.: US 8,888,562 B2
(45) Date of Patent: Nov. 18, 2014

(54) DOUBLE-SIDE POLISHING APPARATUS

(75) Inventors: Tadakazu Miyashita, Nagano (JP); Shogo Koyama, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 568 days.

(21) Appl. No.: 13/290,646

(22) Filed: Nov. 7, 2011

(65) Prior Publication Data

US 2012/0184190 A1 Jul. 19, 2012

(30) Foreign Application Priority Data

Jan. 18, 2011 (JP) ..... 2011-007407

(51) Int. Cl.
*B24B 7/00* (2006.01)
*B24B 9/00* (2006.01)
*B24B 37/28* (2012.01)

(52) U.S. Cl.
CPC ..... *B24B 37/28* (2013.01)
USPC ..... 451/267; 451/262; 451/398

(58) Field of Classification Search
CPC ..... B24B 37/08; B24B 57/02; B24B 37/015; B24B 55/02
USPC ..... 451/262, 267, 268, 269, 398, 446
See application file for complete search history.

(56) References Cited

U.S. PATENT DOCUMENTS 3,666,183 A * 5/1972 Smith ..... 239/463
3,754,710 A * 8/1973 Chimura ..... 239/597
5,762,543 A * 6/1998 Kasprzyk et al. ..... 451/262
6,045,437 A * 4/2000 Tandon et al. ..... 451/288
6,102,784 A * 8/2000 Lichner ..... 451/262
6,113,478 A * 9/2000 Anderson et al. ..... 451/262
6,196,907 B1 * 3/2001 Kahn ..... 451/446
6,299,514 B1 * 10/2001 Boller ..... 451/262
7,485,029 B2 * 2/2009 Kanda et al. ..... 451/267
7,614,934 B2 * 11/2009 Onishi et al. ..... 451/6
7,648,409 B1 * 1/2010 Horiguchi et al. ..... 451/41
7,727,053 B2 * 6/2010 Ueno et al. ..... 451/41
8,485,864 B2 * 7/2013 Furukawa ..... 451/41
2002/0111122 A1 * 8/2002 Korovin et al. ..... 451/41
2002/0115387 A1 * 8/2002 Wenski et al. ..... 451/41
2003/0027506 A1 * 2/2003 Herb et al. ..... 451/60
2004/0082273 A1 * 4/2004 Moriya ..... 451/36
2007/0275639 A1 * 11/2007 Miyashita et al. ..... 451/11

(Continued)

FOREIGN PATENT DOCUMENTS

JP 11262862 A * 9/1999 ..... B24B 57/02
JP 2009-226578 A 10/2009
JP 2009226578 A * 10/2009

*Primary Examiner* — Lee D Wilson
*Assistant Examiner* — Marc Carlson
(74) *Attorney, Agent, or Firm* — Birch, Stewart, Kolasch & Birch, LLP

(57) ABSTRACT

In the double-side polishing apparatus, one end part of a slurry supply hole has a female-tapered face whose inner diameter is gradually increased toward a polishing face of a polishing plate. A pad hole, which corresponds to the slurry supply hole, is formed in a polishing pad covering the slurry supply hole. An edge of the pad hole is located in the slurry supply hole. A fixation pipe, in which a flange section facing the female-tapered face is formed at one end part, is fixed in the slurry supply hole. The edge of the pad hole is sandwiched and held between the female-tapered face of the slurry supply hole and the flange section of the fixation pipe.

18 Claims, 3 Drawing Sheets

(56) References Cited

U.S. PATENT DOCUMENTS

2008/0057831 A1* 3/2008 Kanda et al. ..... 451/7
2008/0227371 A1* 9/2008 Onishi et al. ..... 451/262
2010/0062691 A1* 3/2010 Togawa et al. ..... 451/53
2010/0144249 A1* 6/2010 Kitagawa et al. ..... 451/65
2010/0227535 A1* 9/2010 Moon et al. ..... 451/41
2010/0227536 A1* 9/2010 Moon et al. ..... 451/317
2011/0250824 A1* 10/2011 Yamaguchi et al. ..... 451/5
2012/0220197 A1* 8/2012 Boller et al. ..... 451/11
2013/0260027 A1* 10/2013 Illzumi et al. ..... 427/128

* cited by examiner

DOUBLE-SIDE POLISHING APPARATUS

CROSS-REFERENCE TO RELATED APPLICATION

This application is based upon and claims the benefit of priority of the prior Japanese Patent Application No. P2011-007407, filed on Jan. 18, 2011, and the entire contents of which are incorporated herein by reference.

FIELD

The present invention relates to a double-side polishing apparatus capable of polishing both side faces of a work with a high degree of accuracy.

BACKGROUND

A conventional double-side polishing apparatus for polishing both side faces of a work, e.g., wafer, comprises: a lower polishing plate having an upper polishing face, on which a polishing pad is adhered; an upper polishing plate being located above the lower polishing plate and capable of moving upward and downward, the upper polishing plate having a lower polishing face, on which a polishing pad is adhered; a carrier being provided between the lower polishing plate and the upper polishing plate, the carrier having a through-hole for holding the work; a plate driving unit for rotating the lower polishing plate and the upper polishing plate about their axes; a carrier driving unit for rotating the carrier; a slurry supply hole being formed in at least one of the polishing plates; and a slurry supply pipe being connected with the slurry supply hole, the slurry supply pipe supplying slurry, which is sent from a slurry supply source, to the polishing pads via the slurry supply hole. The lower polishing plate, the upper polishing plate and the carrier are rotated, with supplying the slurry to the polishing pads, so as to polish the both side faces of the work sandwiched between the polishing plates.

In a part of the polishing pad covering the slurry supply hole of the polishing plate, a hole or crisscross cut lines are formed so as to introduce the slurry onto the polishing pads.

In case that the polishing pads are composed of unwoven cloth of a relatively soft material, e.g., polyurethane, even if the hole or the cut lines are formed in the polishing pads, there is little possibility of damaging the work.

These days, in case of polishing a hard work, e.g., SIC substrate, a laminated polishing pad, which is constituted by a fiber layer (including woven cloth) and a resin layer, are occasionally used. If the hole or the cut lines are formed in the laminated polishing pad, end faces of the fiber layer (e.g., outer circumferential face, inner face of the hole, cut faces of the cut lines) are ragged, so the polishing operation will be badly influenced. If the carrier is caught by the ragged polishing pads, the carrier will be crushed.

Thus, as disclosed in Japanese Laid-open Patent Publication No. 2009-226578, the end faces of the fiber layer is melt-treated so as to prevent the end faces from being ragged.

In case of melt-treating the end face of the fiber layer as disclosed in the Japanese laid-open patent publication, it is relatively easy to melt the outer circumferential face of the polishing pad. However, the hole or the cut lines are formed in a narrow area, so it is very difficult to melt the inner face of the hole or the cut faces of the cut lines. Especially, in case of melt-treating the cut lines, the cut lines will be closed.

Even if the end faces are melt-treated, a slurry supply hole exists in a polishing face of a polishing plate. Therefore, the end faces of the fiber layer, which have been melt-treated, exist in the surface of the polishing pads facing the work. The fiber layer is not ragged, but the end faces, which have been melt-treated and become hard, will damage the work.

SUMMARY

Accordingly, it is objects to provide a double-side polishing apparatus capable of solving the above described problems of the conventional polishing apparatuses. Namely, the double-side polishing apparatus of the present invention is capable of accurately polishing a work even if polishing pads include fiber layers.

To achieve the object, the present invention has following structures.

Namely, the double-side polishing apparatus comprises:

a lower polishing plate having an upper polishing face, on which a polishing pad is adhered;

an upper polishing plate being located above the lower polishing plate and capable of moving upward and downward, the upper polishing plate having a lower polishing face, on which a polishing pad is adhered;

a carrier being provided between the lower polishing plate and the upper polishing plate, the carrier having a through-hole for holding a work;

a plate driving unit for rotating the lower polishing plate and the upper polishing plate about their axes;

a carrier driving unit for rotating the carrier;

a slurry supply hole being formed in at least one of the polishing plates; and a slurry supply pipe being connected with the slurry supply hole, the slurry supply pipe supplying slurry, which is sent from a slurry supply source, to the polishing pads via the slurry supply hole, the lower polishing plate, the upper polishing plate and the carrier are rotated, with supplying the slurry to the polishing pads, so as to polish both side faces of the work sandwiched between the polishing plates, the double-side polishing apparatus is characterized in, that one end part of the slurry supply hole, which is opened in the polishing face of at least one of the polishing plates, includes a female-tapered face whose inner diameter is gradually increased toward the polishing face, that a pad hole, which corresponds to the slurry supply hole, is formed in the polishing pad covering the slurry supply hole, that an edge of the pad hole is located in the slurry supply hole, that a fixation pipe, in which a flange section facing the female-tapered face is formed at one end part, is fixed in the slurry supply hole, and that the edge of the pad hole is sandwiched and held between the female-tapered face of the slurry supply hole and the flange section of the fixation pipe.

Preferably, the other end part of the fixation pipe is outwardly projected from the polishing plate as a projected part, a male screw section is formed in the projected part, and a nut is screwed with the male screw section so as to fix the fixation pipe to the polishing plate.

Preferably, a part of the projected part, which is located on the outer side of the male screw section, is formed as a joint section connected to the slurry supply pipe.

Preferably, the edge of the pad hole is divided into a plurality of tongue-shaped parts, and the tongue-shaped parts are sandwiched and held between the female-tapered face of the slurry supply hole and the flange section of the fixation pipe.

Preferably, an engage section, which is capable of engaging with a concave section formed in an inner face of the slurry supply hole, is formed in the other end part of the fixation pipe. In this case, a joint connected to the slurry supply pipe may be attached to the other end part of the slurry supply hole.

Preferably, in the above described structures, one end of the fixation pipe is located in the one end part of the slurry supply hole, in which the female-tapered face is formed, without projecting toward the polishing pad.

In the present invention, the polishing pad can be suitably fixed at a position corresponding to the slurry supply hole with a simple structure, and the both side faces of the work can be polished with a high degree of accuracy.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Figure 1:
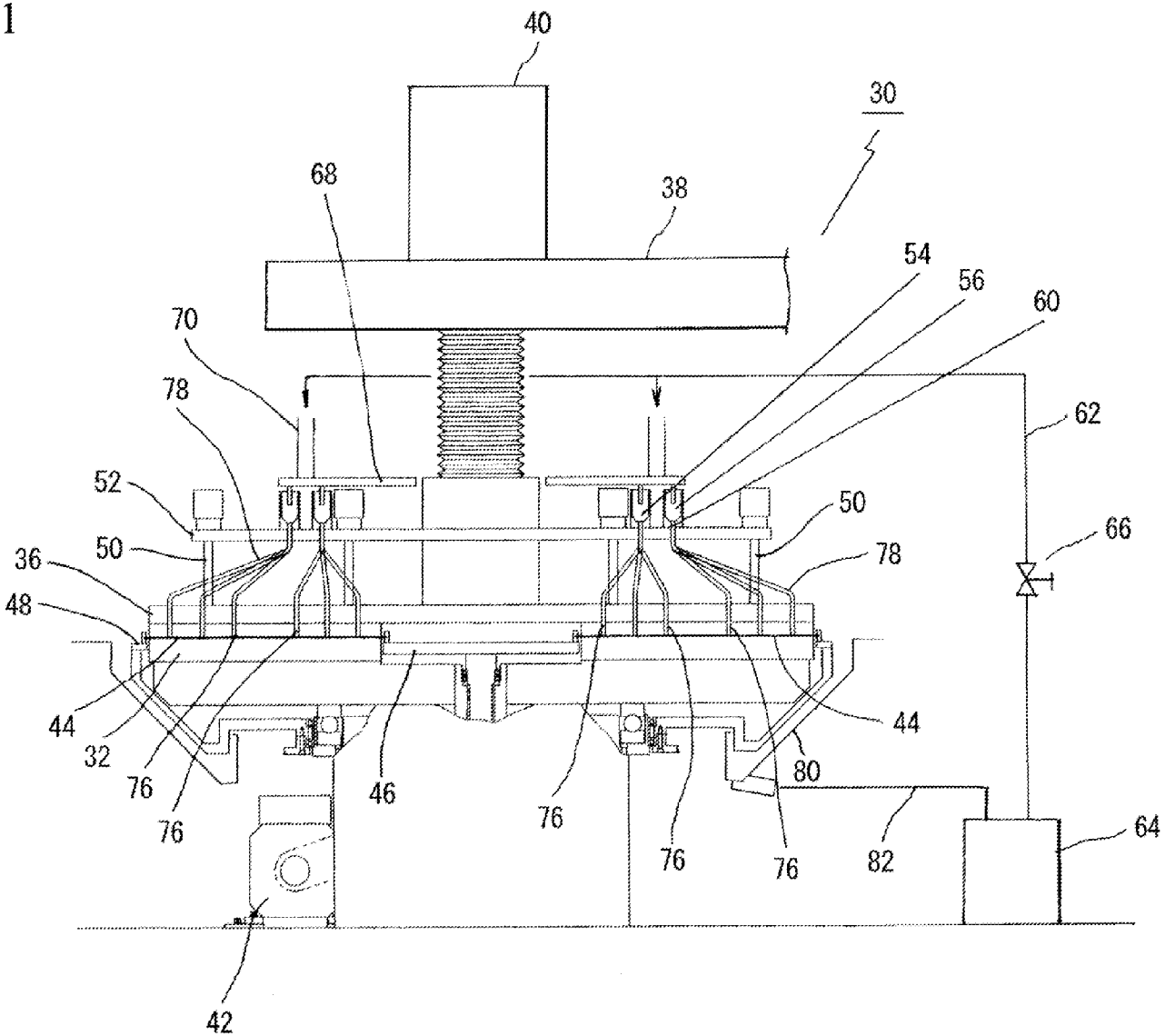
FIG. 1 is a front view of a double-side polishing apparatus.

FIG. 1 is a front view of a double-side polishing apparatus 30. A basic structure of the double-side polishing apparatus 30 is publicly known, so it will be briefly explained.

The double-side polishing apparatus 30 includes: a lower polishing plate 32 having an upper polishing face; and an upper polishing plate 36 being located above the lower polishing plate 32 and capable of moving upward and downward, the upper polishing plate 36 having a lower polishing face.

Figure 4:
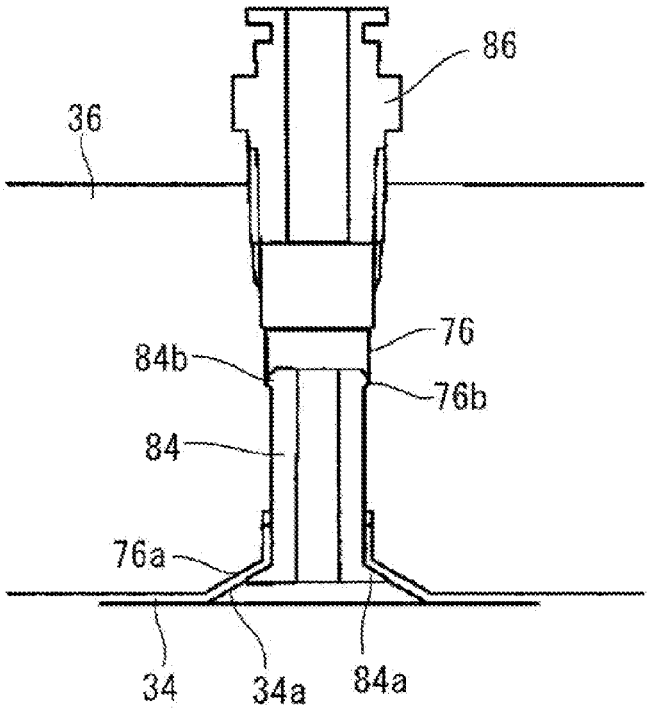
FIG. 4 is an explanation view of a fixation structure of a polishing pad.

Polishing pads 34 are respectively adhered on the upper polishing face of the lower polishing plate 32 and the lower polishing face of the upper polishing plate 36 (see FIG. 4). Each of the polishing pads 34 may be composed of unwoven cloth and may have a laminated structure including a fiber layer and a resin layer. The material and the structure of the polishing pads 34 are not limited to the embodiment.

The lower polishing plate 32 and the upper polishing plate 36 are rotated, in the opposite directions, about their axes. The upper polishing plate 36 is rotated, about its axis, and moved upward and downward by a driving unit 40, which is provided to a supporting frame 38. The driving unit 40 includes a vertical driving mechanism, e.g., cylinder unit (not shown), and a rotary driving mechanism, e.g., motor (not shown).

The lower polishing plate 32 is rotated by a motor 42.

Figure 2:
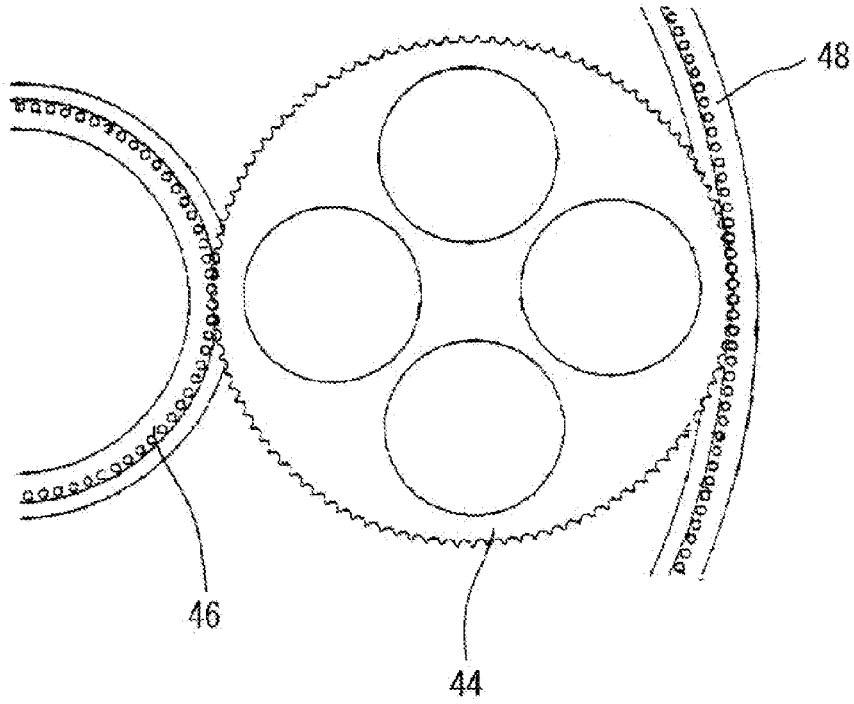
FIG. 2 is an explanation view of a carrier.

Carriers 44, each of which has through-holes for holding works, is provided between the lower polishing plate 32 and the upper polishing plate 36. The carriers 44 are rotated about their axes and orbited by a sun gear (inner pin gear) 46, which is located at the center of the lower polishing plate 32, and an internal gear (outer pin gear) 48 (see FIG. 2). The sun gear 46 and the internal gear 48 are rotated by known mechanisms. Note that, the sun gear 46 and the internal gear 48 are not limited to the pin gears. Other known gears may be employed.

A rotary plate 52 is connected to the upper polishing plate 36 by a plurality of supporting rods 50, so that the rotary plate 52 is rotated together with the upper polishing plate 36.

A plurality of ring-shaped ducts, e.g., two ducts 54 and 56, are concentrically fixed on the rotary plate 52.

Slurry holes 60 are formed in a bottom part of each of the ducts 54 and 56.

Slurry is supplied to the ring-shaped ducts 54 and 56, via a supply pipe 62, from a slurry supply source 64. A flow regulation valve 66 is provided to the supply pipe 62.

Firstly, the slurry is supplied to slurry receiving pipes 70, which are upwardly erected from an arm 68. The slurry is distributed from the slurry receiving pipes 70 to the ring-shaped ducts 54 and 56 via distributing tubes (not shown).

The arm 68 is connected to the supporting frame 38 by suitable connection members (not shown).

Figure 3:
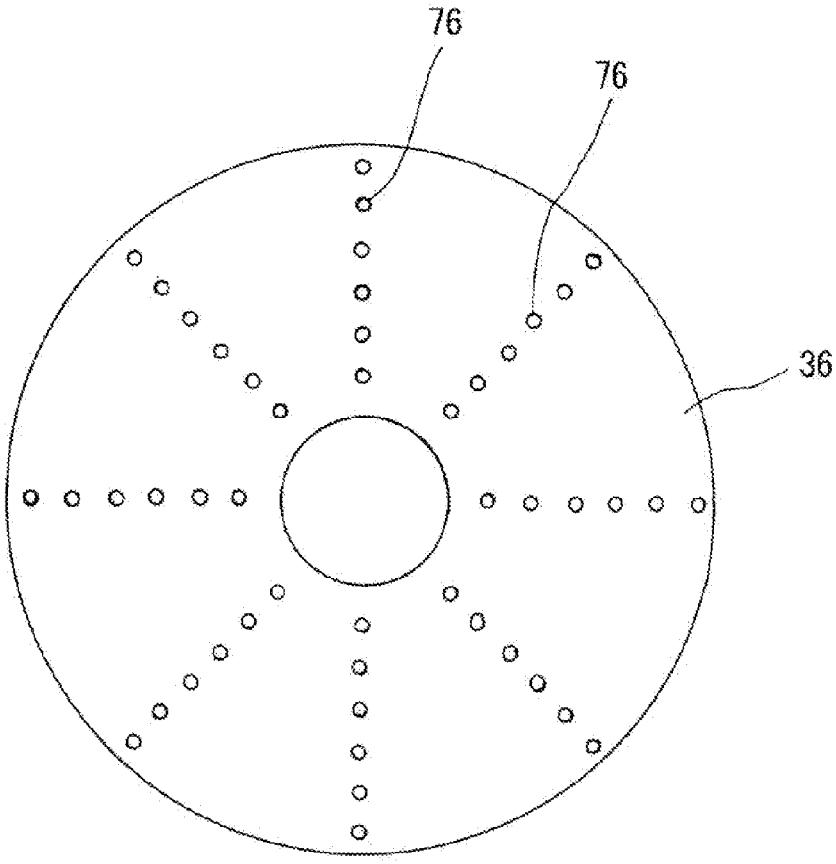
FIG. 3 is an explanation view of an upper polishing plate showing arrangement of slurry supply holes.

As shown in FIG. 3, slurry supply holes 76 are radially arranged in the upper polishing plate 36. The slurry supply holes 76 are communicated with the slurry holes 60 of the ring-shaped ducts 54 and 56 via slurry supply pipes 78. The slurry is supplied to the upper polishing face of the lower polishing plate 32 via the slurry supply pipes 78.

The slurry is introduced from the inner duct 54 to three of each radial line of the slurry supply holes 76 which are located an inner part of the upper polishing plate 36, so that the slurry can be supplied to an inner part of the polishing pad 34 of the lower polishing plate 32.

On the other hand, the slurry is introduced from the outer duct 56 to three of each radial line of the slurry supply holes 76 which are located an outer part of the upper polishing plate 36, so that the slurry can be supplied to an outer part of the polishing pad 34 of the lower polishing plate 32.

The slurry flowing downward from the lower polishing plate 32 is returned to the slurry supply source 64, via collecting ducts 80 and a return pipe 82, for reuse.

By rotating the lower polishing plate 32, the upper polishing plate 36 and the carriers 44, with supplying the slurry to the polishing pads 34 via the slurry supply pipes 78, both side faces of the works sandwiched between the polishing plates 32 and 36 can be polished.

Note that, number of the ring-shaped ducts is not limited to two. One ring-shaped duct or three or more ring-shaped ducts may be employed.

FIG. 4 is an explanation view of a fixation structure of the polishing pad 34, in which the polishing pad 34 is fixed to the upper polishing plate 36 at positions corresponding to the slurry supply holes 76 thereof.

In FIG. 4, one end part (a lower end part) of the slurry supply hole 76 is opened in the lower polishing face of the upper polishing plate 36, on which the polishing pad 34 is adhered, and includes a female-tapered face 76*a* whose inner diameter is gradually increased toward the lower polishing face.

A crisscross cut lines (not shown) is formed in a part of the polishing pad 34, which covers the slurry supply hole 76, so as to form a pad hole. An opening edge of the pad hole is divided into a plurality of tongue-shaped parts, e.g., four tongue-shaped parts 34*a*.

A fixation pipe 84 has one end part (a lower end part), in which a flange section 84*a* having a male-tapered face facing the female-tapered face 76*a* is formed, and the other end part (an upper end part), in which an engage section 84*b* capable of engaging with a concave section 76*b* formed in an inner face of the slurry supply hole 76 is formed. The engage section 84*b* may be a plurality of tongue-shaped sections or a flange-shaped section.

The tongue-shaped parts 34*a* of the polishing pad 34 are fixed to the upper polishing plate 36 by the fixation pipe 84.

Namely, the four tongue-shaped parts 34*a* are bent and placed in the lower end part (the female-tapered part) of the slurry supply hole 76. Then, the fixation pipe 84 is inserted into the slurry supply hole 76 from the other end part, and the engage section 84*b* is elastically engaged with the concave section 76*b*, so that the fixation pipe 84 is fixed in the upper polishing plate 36. With this structure, the tongue-shaped parts 34*a* are strongly sandwiched and held between the female-tapered face 76*a* of the slurry supply hole 76 and the male-tapered face of the flange section 84*a* of the fixation pipe 84. Further, detaching the fixation pipe 84 can be prevented.

If the tongue-shaped parts 34*a* are long, they are extended beyond the female-tapered part, and their front ends enter the slurry supply hole 76. In this case, the front ends of the tongue-shaped parts 34*a* may be sandwiched and held between the inner face of the slurry supply hole 76 and an outer face of the fixation pipe 84.

A known pipe joint 86 is attached to the other end part of the slurry supply hole 76. With this structure, each of the slurry supply pipes 78 can be connected to the slurry supply hole 76.

By bending the tongue-shaped parts 34*a* toward the slurry supply hole 76 and holding and fixing the tongue-shaped parts 34*a* between the female-tapered face 76*a* of the slurry supply hole 76 and the male-tapered face of the flange section 84*a*, end faces of the tongue-shaped parts 34*a* never contact the works. Even if the polishing pad 34 includes the fiber layer, the end faces of the tongue-shaped parts 34*a* are not ragged, polishing operation is not badly influenced and the works can be polished with a high degree of accuracy. Further, crush of the carrier 44, which is caused by being caught by the ragged polishing pad 34, can be prevented, so that the both side faces of the works can be polished stably.

When the tongue-shaped parts 34*a* are bent toward the slurry supply hole 76, the tongue-shaped parts 34*a* are bent along the female-tapered face 76*a*, without sharply bending at right angle, so that the bent corners of the tongue-shaped parts 34*a* never damage the works. To bend each of the tongue-shaped parts 34*a* at suitable wide angle, a suitable angle between the female-tapered face 76*a* and the polishing face of the polishing plate may be about 30-45 degrees.

Number of the tongue-shaped parts 34*a* is not limited. For example, three cut lines crossing at one point may be formed, in the polishing pad 34, to produce six tongue-shaped parts. By increasing the number of the tongue-shaped parts 34*a*, a width of a bent section of each of the tongue-shaped parts 34*a* can be narrower, so that a curve of the bent section can be smaller and impact applied to the works can be smaller In the above described embodiment, each of the pad holes is formed, in the polishing pad 34, by forming the crisscross cut lines at the position corresponding to each of the slurry supply holes 76. Further, the pad holes may be small holes (not shown), whose diameter is smaller than that of the female-tapered parts of the slurry supply holes 76 and which are formed at the positions corresponding to the slurry supply holes 76. In this case too, an opening edge of each of the small holes (the pad holes) is bent toward the female-tapered part of the slurry supply hole 76, and then the bent edge is sandwiched and held between the female-tapered face 76*a* of the slurry supply hole 76 and the male-tapered face of the flange section 84*a* of the fixation pipe 84. Note that, if it is difficult to bend the opening edge of the pad hole toward the female-tapered part of the slurry supply hole 76, the opening edge can be easily bent and pressed into the female-tapered part by using a suitable jig (not shown). Further, notches may be formed in the opening edge of each of the small holes so as to form tongue-shaped parts (not shown). The tongue-shaped parts may be bent toward the female-tapered part.

The flange section 84*a* need not have the male-tapered face. Even if no male-tapered face is formed in the flange section 84*a*, the opening edge of the pad hole of the polishing pad 34 can be sandwiched and held between the female-tapered face 76*a* and the flange section 84*a*.

Figure 5:
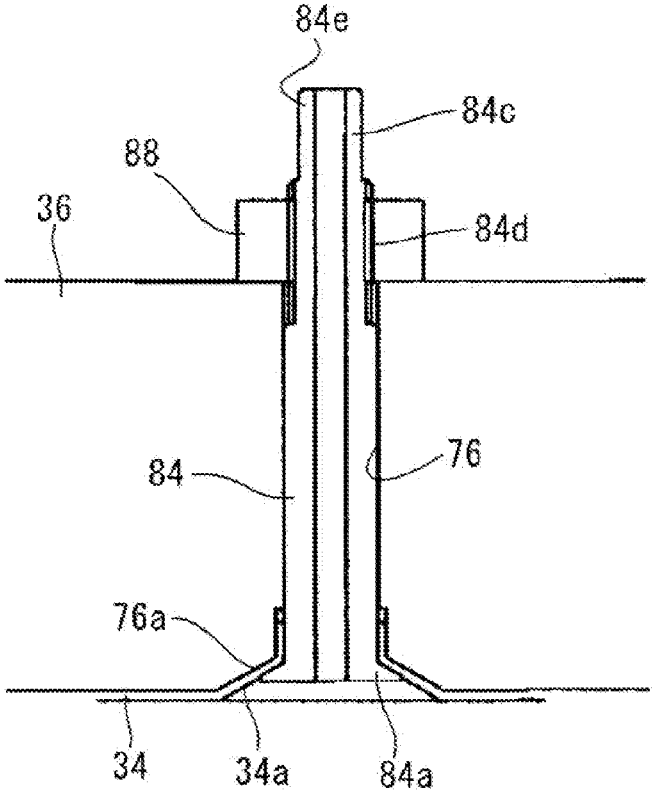
FIG. 5 is an explanation view of another fixation structure of the polishing pad.

FIG. 5 shows another example of the fixation structure of the polishing pad 34. Note that, the structural elements explained above are assigned the same symbols, and explanation will be omitted.

The other end part (the upper end part) of the fixation pipe 84 is projected, upward from the upper polishing plate 36, as a projected part 84*c*. A male screw section 84*d* is formed on an outer circumferential face of the projected part 84*c*, and a nut 88 is screwed with the male screw section 84*d* so as to fix the fixation pipe 84 in the upper polishing plate 36. By fixing the fixation pipe 84, the tongue-shaped parts 34*a* of the polishing pad 34 can be sandwiched and held between the tapered faces.

A part of the projected part 84*c* of the fixation pipe 84, which is located on the outer side (upper side) of the male screw section 84*d*, is formed as a joint section 84*e* connecting the slurry supply pipe 78. With this structure, the fixation pipe 84 is capable of not only holding the tongue-shaped parts 34*a* but also acting as the joint connecting the slurry supply pipe 78. Therefore, the structure of the double-side polishing apparatus can be simplified. The joint section 84*e* may be a mere cylindrical section which can be fitted into the slurry supply pipe 78. Further, the joint section 84*e* may have suitable clamping means (not shown).

In this example too, the pad holes may be formed by forming the crisscross cut lines or the small holes, whose diameter is smaller than that of the female-tapered parts, in the polishing pads 34.

In the above described embodiments, one end (a lower end) of each of the fixation pipes 84 is located in the female-tapered part of each of the slurry supply holes 76, without projecting toward the polishing pad 34.

In the above described embodiments, the slurry supply holes 76 are formed in the upper polishing plate 36 so as to flow the slurry downward from the upper polishing plate 36 and supply the slurry to the polishing pad 34 of the lower polishing plate 32. In some embodiments, the slurry supply holes (not shown) may be formed in the lower polishing plate 32, and the slurry may be pressurized and supplied to the polishing pads 34 of the both polishing plates 32 and 36 via the lower polishing plate 32. In this case too, the polishing pads 34 are treated, as well as the above described embodiments, so as to prevent the end faces of the tongue-shaped parts 34*a*, etc. from being ragged.

A material of the polishing pads 34 is not limited to that of the above described embodiments. For example, a conventional uneven cloth which is in no danger of being ragged can be used as the material of the polishing pads 34. In this case too, an opening edge of each of the pad holes is bent toward the female-tapered part of each of the slurry supply holes, and then the opening edge is held by fitting the fixation pipe, as well as the above described embodiments. With this structure, the works can be precisely polished without being badly influenced All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention has been described in detail, it should be understood that the various changes, substitutions, and alternations could be made hereto without departing from the spirit and scope of the invention.

What is claimed is:

1. A double-side polishing apparatus, comprising:

a lower polishing plate having an upper polishing face, on which a polishing pad is adhered;

an upper polishing plate being located above the lower polishing plate and capable of moving upward and downward, the upper polishing plate having a lower polishing face, on which a polishing pad is adhered;

a carrier being provided between the lower polishing plate and the upper polishing plate, the carrier having a through-hole for holding a work;

a plate driving unit for rotating the lower polishing plate and the upper polishing plate about their axes;

a carrier driving unit for rotating the carrier;

a slurry supply hole being formed in at least one of the polishing plates; and a slurry supply pipe being connected with the slurry supply hole, the slurry supply pipe supplying slurry, which is sent from a slurry supply source, to the polishing pads via the slurry supply hole, wherein the lower polishing plate, the upper polishing plate and the carrier are rotated, with supplying the slurry to the polishing pads, so as to polish both side faces of the work sandwiched between the polishing plates, the double-side polishing apparatus being characterized in, that one end part of the slurry supply hole, which is opened in the polishing face of at least one of the polishing plates, includes a female-tapered face whose inner diameter is gradually increased toward the polishing face, that a pad hole, which corresponds to the slurry supply hole, is formed in the polishing pad covering the slurry supply hole, that an edge of the pad hole is located in the slurry supply hole, that a fixation pipe, in which a flange section facing the female-tapered face is formed at one end part, is fixed in the slurry supply hole, and that the edge of the pad hole is sandwiched and held between the female-tapered face of the slurry supply hole and the flange section of the fixation pipe.

2. The double-side polishing apparatus according to claim 1, wherein the other end part of the fixation pipe is outwardly projected from the polishing plate as a projected part, a male screw section is formed in the projected part, and a nut is screwed with the male screw section so as to fix the fixation pipe to the polishing plate.

3. The double-side polishing apparatus according to claim 2, wherein a part of the projected part, which is located on the outer side of the male screw section, is formed as a joint section connected to the slurry supply pipe.

4. The double-side polishing apparatus according to claim 1, wherein the edge of the pad hole is divided into a plurality of tongue-shaped parts, and the tongue-shaped parts are sandwiched and held between the female-tapered face of the slurry supply hole and the flange section of the fixation pipe.

5. The double-side polishing apparatus according to claim 2, wherein the edge of the pad hole is divided into a plurality of tongue-shaped parts, the tongue-shaped parts are sandwiched and held between the female-tapered face of the slurry supply hole and the flange section of the fixation pipe.

6. The double-side polishing apparatus according to claim 3, wherein the edge of the pad hole is divided into a plurality of tongue-shaped parts, the tongue-shaped parts are sandwiched and held between the female-tapered face of the slurry supply hole and the flange section of the fixation pipe.

7. The double-side polishing apparatus according to claim 1, wherein an engage section, which is capable of engaging with a concave section formed in an inner face of the slurry supply hole, is formed in the other end part of the fixation pipe.

8. The double-side polishing apparatus according to claim 1, wherein a joint connected to the slurry supply pipe is attached to the other end part of the slurry supply hole.

9. The double-side polishing apparatus according to claim 7, wherein a joint connected to the slurry supply pipe is attached to the other end part of the slurry supply hole.

10. The double-side polishing apparatus according to claim 1, wherein one end of the fixation pipe is located in the one end part of the slurry supply hole, in which the female-tapered face is formed, without projecting toward the polishing pad.

11. The double-side polishing apparatus according to claim 2, wherein one end of the fixation pipe is located in the one end part of the slurry supply hole, in which the female-tapered face is formed, without projecting toward the polishing pad.

12. The double-side polishing apparatus according to claim 3, wherein one end of the fixation pipe is located in the one end part of the slurry supply hole, in which the female-tapered face is formed, without projecting toward the polishing pad.

13. The double-side polishing apparatus according to claim 4, wherein one end of the fixation pipe is located in the one end part of the slurry supply hole, in which the female-tapered face is formed, without projecting toward the polishing pad.

14. The double-side polishing apparatus according to claim 5, wherein one end of the fixation pipe is located in the one end part of the slurry supply hole, in which the female-tapered face is formed, without projecting toward the polishing pad.

15. The double-side polishing apparatus according to claim 6, wherein one end of the fixation pipe is located in the one end part of the slurry supply hole, in which the female-tapered face is formed, without projecting toward the polishing pad.

16. The double-side polishing apparatus according to claim 7, wherein one end of the fixation pipe is located in the one end part of the slurry supply hole, in which the female-tapered face is formed, without projecting toward the polishing pad.

17. The double-side polishing apparatus according to claim 8, wherein one end of the fixation pipe is located in the one end part of the slurry supply hole, in which the female-tapered face is formed, without projecting toward the polishing pad.

18. The double-side polishing apparatus according to claim 9, wherein one end of the fixation pipe is located in the one end part of the slurry supply hole, in which the female-tapered face is formed, without projecting toward the polishing pad.

* * * * *